US006769222B2

(12) United States Patent
Billante

(10) Patent No.: US 6,769,222 B2
(45) Date of Patent: Aug. 3, 2004

(54) WALL STRAIGHTENING DEVICE AND METHOD OF INSTALLATION

(76) Inventor: Joseph W. Billante, 136 Siek Rd., Washington, PA (US) 15301

( * ) Notice: Subject to any disclaimer, the term of this patent is extended or adjusted under 35 U.S.C. 154(b) by 0 days.

(21) Appl. No.: 10/120,306

(22) Filed: Apr. 10, 2002

(65) Prior Publication Data

US 2003/0192280 A1 Oct. 16, 2003

(51) Int. Cl.[7] ..... E02D 27/00

(52) U.S. Cl. ..... 52/742; 52/169.6; 52/514; 52/169.8; 405/262; 405/284; 405/259

(58) Field of Search ..... 52/742, 169.6, 52/514, 169.8, 162, 293.2, 127.2, 712; 405/262, 284, 259

(56) References Cited

U.S. PATENT DOCUMENTS 4,068,427 A * 1/1978 Camardo ..... 52/127.2
4,189,891 A 2/1980 Johnson et al.
4,353,194 A * 10/1982 Norton ..... 52/741.13
4,970,835 A 11/1990 Harmon
5,701,715 A * 12/1997 Johnson et al. ..... 52/741.13
6,145,260 A * 11/2000 Morton ..... 52/293.2

* cited by examiner

*Primary Examiner*—Carl D. Friedman
*Assistant Examiner*—Nahid Amiri
(74) *Attorney, Agent, or Firm*—Carothers & Carothers

(57) ABSTRACT

A below ground wall anchoring and straightening device including a horizontally disposed elongate rod member and an earth anchor secured to one end of the rod member. An elongate wall brace plate is attached intermediate its ends to the other end of the rod member and a wall brace plate extends upright in its direction of elongation and this elongate plate is secured at its bottom end to a base portion of the wall structure to be straightened. The rod member includes a fastener for engaging the rod member and thereby pressing the elongate plate against the wall to anchor and straighten the wall.

4 Claims, 4 Drawing Sheets

WALL STRAIGHTENING DEVICE AND METHOD OF INSTALLATION

BACKGROUND OF THE INVENTION

The present invention relates generally to an apparatus and method for straightening a basement wall which has been pushed in by hydrostatic pressure, and more particularly to a straightening apparatus and method which utilizes an anchoring device.

A very common problem with many below ground basement walls is that water tends to build up on the outside of such basement walls which causes a very high hydrostatic pressure against the wall. If this pressure becomes significant, it causes the wall to be pushed into the basement to some extent. Commonly, a large horizontal crack will appear in the wall. Besides the obvious problem of the unsightly nature of the crack, it will also permit water into the basement and if the hydrostatic pressure continues to increase the wall could eventually collapse.

The most common accepted methods and apparatus for straightening a basement wall are illustrated in U.S. Pat. Nos. 4,189,891 and 4,970,835.

The former patent relates to a method for anchoring and straightening a wall wherein a hole is formed in the ground at a distance from the wall and an opening is provided in the wall from the inside below ground level. Then an elongated rod member is positioned through the opening in the wall and forced through the ground so that one end of the member extends into the hole previously formed. An anchor structure, such as an anchor plate, is secured to one end of the rod member in the hole, and a wall plate is attached to the other end of the elongated rod member inside and against the wall. The wall plate is then forced against the wall by use of a threaded attaching mechanism for thereby straightening the wall.

The wall anchoring and straightening device of the latter referenced patent is in many ways similar, but eliminates the need for digging the hole into the earth at a spaced distance from the wall. This device comprises a horizontal elongated rod member having a chisel point end which is driven through the foundation wall into the earth and carries a plurality of pivotal spade arms adjacent the chisel point. The end of the rod member which is positioned at the interior of the wall is provided with threads. In similar fashion a wall plate is forced against the wall by a nut which is tightened to pull the rod member and chisel arm and spade arms closer to the foundation wall which thereby firmly causes the spade arms to spread and dig in to the surrounding earth to provide an anchor. Further tightening of the nut causes the wall plate to be forced against the wall and to straighten the wall.

The present invention pertains to an improvement on these two prior art methods and apparatus for anchoring and straightening a below ground wall.

SUMMARY OF THE INVENTION

The below ground wall anchoring and straightening device of the present invention also, as is the case with the prior art systems, incorporates a horizontally disposed elongate rod member and an earth anchoring means or mechanism secured to one end of the rod member. This earth anchoring means may of course be of either type as mentioned in the referenced patents.

The apparatus and method of the present invention is characterized in that instead of using the conventional wall plate described by the prior art, the apparatus and method of the present invention utilizes an elongate wall brace plate. This wall brace plate extends upright in its direction of the elongation and includes a securing means or mechanism at its bottom end for securing the bottom end of the elongate wall brace plate to a base portion of the wall structure. Then, as before, a fastener engages the rod member and presses the elongate plate against the wall to be anchored and straightened.

The advantage is that the plate is elongate, usually over seven feet tall, and is secured at its bottom end to a base portion of the wall and this wall brace plate is of sufficient rigidity to thereby anchor, brace and straighten the wall for its entire height, whereas the backup plates of the prior art structures engage only a small portion of the wall and accordingly did not guarantee complete and full straightening and anchoring and bracing of the wall as is accomplished by the apparatus and method of the present invention.

The elongate wall brace plate is preferably constructed of a rigid steel strip which has a vertical slot therein to adjustably receive the rod member therethrough. Normally the fastener device for pressuring the plate against the wall is a threaded nut, but other acceptable fastening devices may be utilized.

BRIEF DESCRIPTION OF THE DRAWINGS

Since the present invention is an improvement in the structure and methods of U.S. Pat. Nos. 4,189,891 and 4,970,835, the following drawings are extracted from these patent references and are appropriately modified to illustrate the principals of the present invention, thereby rendering it more easy to comprehend the improvements of the present invention.

Other objects and advantages appear hereinafter in the following description and claims. The accompanying drawings show, for the purpose of exemplification, without limiting the invention or appended claims, certain practical embodiments of the present invention wherein:

DESCRIPTION OF THE PREFERRED EMBODIMENTS

Figure 1:
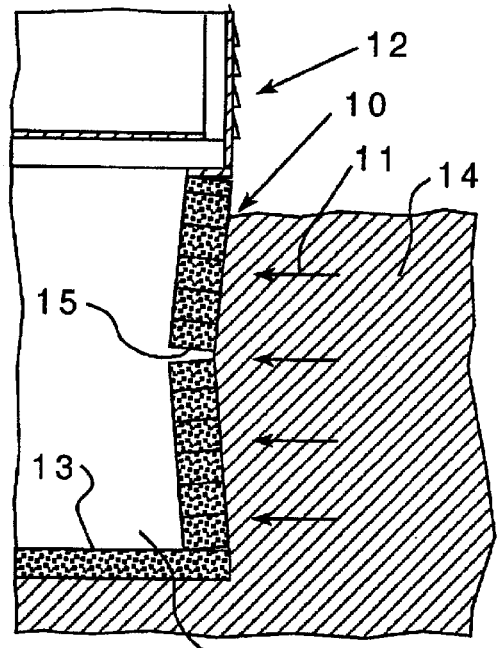
FIG. 1 is a cross sectional view of a basement wall which has been pushed in by hydrostatic pressure forces.

Referring now to the drawings wherein like reference numerals designate identical or corresponding parts throughout the several views, FIG. 1 shows a wall 10 which has been pushed inwardly because of hydrostatic forces against the exterior thereof as indicated by the force arrows 11. A building 12, such as a house, rests on top of the basement wall 10 and a concrete slab 13 supports the bottom of the wall 10. The numeral 14 designates the earth around the basement wall 10. Attention is directed to the crack 15 in the wall 10 which can allow water from within the ground 14 to seep into the basement and which crack 15 also can become large enough due to hydrostatic forces 11 to cause the entire wall 10 to collapse within the basement.

Figure 2:
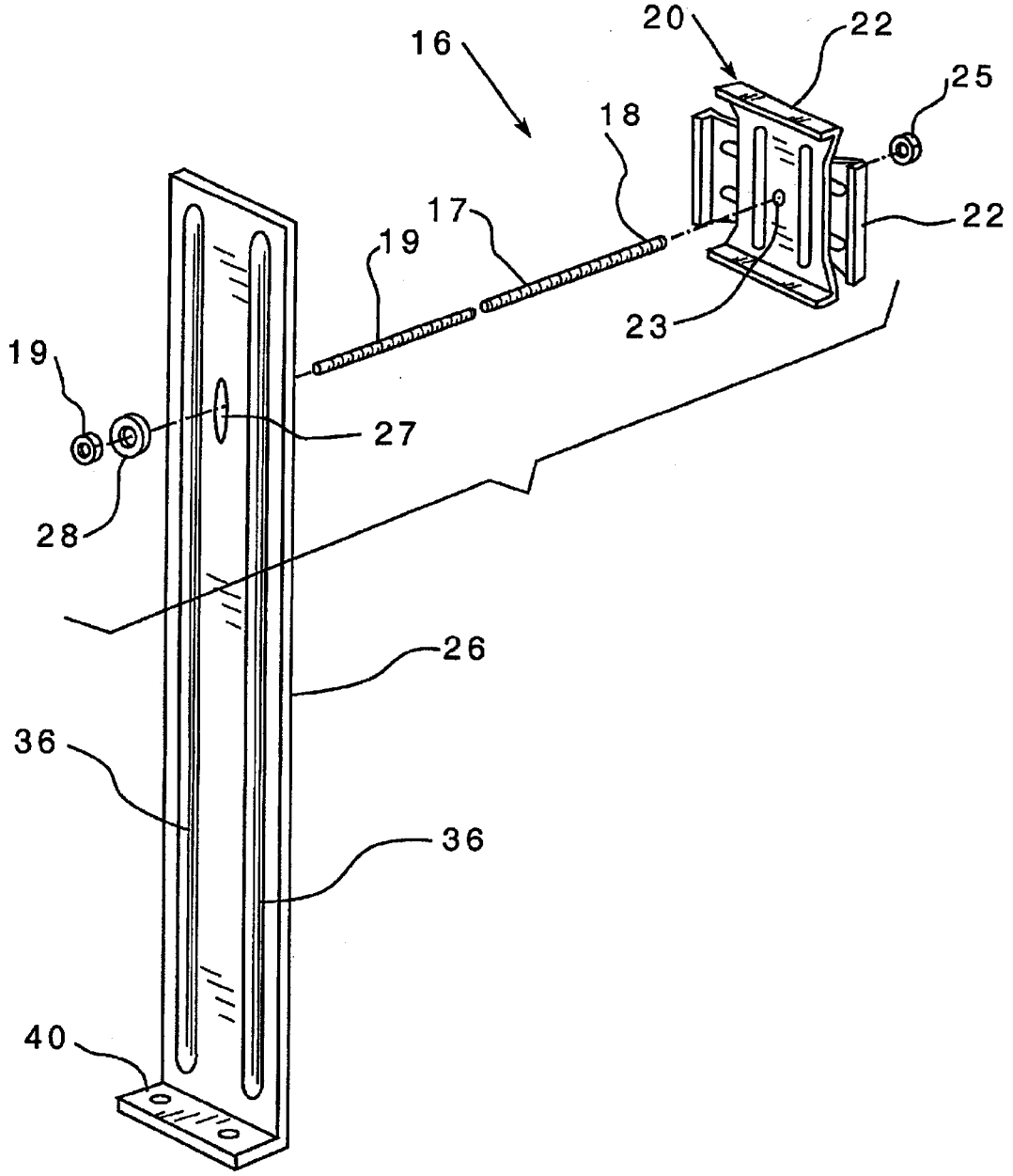
FIG. 2 is an exploded perspective view of an anchoring apparatus utilized in the present invention.

Referring now to FIG. 2 an anchoring structure 16 is shown. The anchoring structure includes a shaft or elongate rod member 17 which is externally threaded on the ends 18 and 19. An anchoring plate 20, comprised of a pair of plates 21 and 22 welded together, has an opening 23 disposed centrally thereof. A pair of flanges 24 are welded to the plate 22 and are spaced so as to allow a nut 25 to be received therein and held from rotating so that the rod member 17 can be threaded into the nut 25, thereby securing the anchoring plate structure 20 to the rod member 17. An elongated upright wall brace plate 26 is provided for the other end of the rod member 17 and includes a central vertical slot 27 for allowing the end 19 of the rod member 17 to extend therethrough. A washer 28 and an internally threaded nut structure 29 is provided for holding the wall plate 26 from moving outwardly with respect to the rod member 17 once the nut 29 is threadably received on the threads 19 of the rod member 17.

Figure 3:
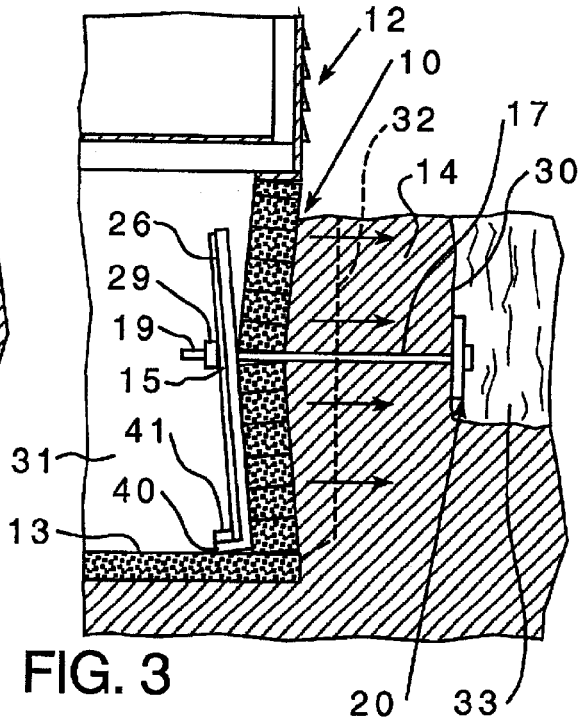
FIG. 3 is a cross sectional view similar to that of FIG. 1, but showing an initial positioning of the anchoring apparatus of FIG. 2 as utilized in the present invention.

In order to straighten the wall 10 shown in FIG. 1, a hole 30 is first dug into the earth 14 as is shown in FIG. 3. Then from inside of the basement 31, an opening must be formed through the crack 15 to allow the rod member 17 to be driven therethrough so that the end 18 extends into the hole 30. Normally this would require the use of a drill or chisel or the like in order to make an opening through the crack 15, but it is entirely possible that an opening large enough to receive the shaft 16 would already be present if the wall 10 had buckled to a large degree. Once the rod member 17 is driven inwardly to the position shown in FIG. 3, then the nut 25 is utilized by placing it between the flanges 24, aligning it with the threads 18 of the rod member 17 and then rotating the entire anchoring plate structure 20 so that the nut 25 is firmly secured onto the rod member 17. While this is a preferred embodiment of the invention, it is to be understood that other anchoring structures could be used instead of the specific anchoring structure 20 shown, as will be explained in more detail hereinafter, and likewise fastening structures other than the threaded one shown by threads 18 and nut 25 can be utilized to secure such anchoring structure to the rod member 17 and still be within the inventive concept of this invention.

The next step for straightening the wall 10 is then to slide the elongate wall brace plate 26 onto the rod member 17 such that the slot 27 surrounds the threads 19 of the rod member 17. Then the washer 28 is placed over the end 19 of the rod member 17 and the nut 29 is threaded onto the threads 19 resulting in the structure as substantially shown in FIG. 3. Next, the foot 40 at the bottom end plate 26 is secured with concrete bolts 41 to concrete slab 13 at an interior base portion of wall 10.

Figure 5:
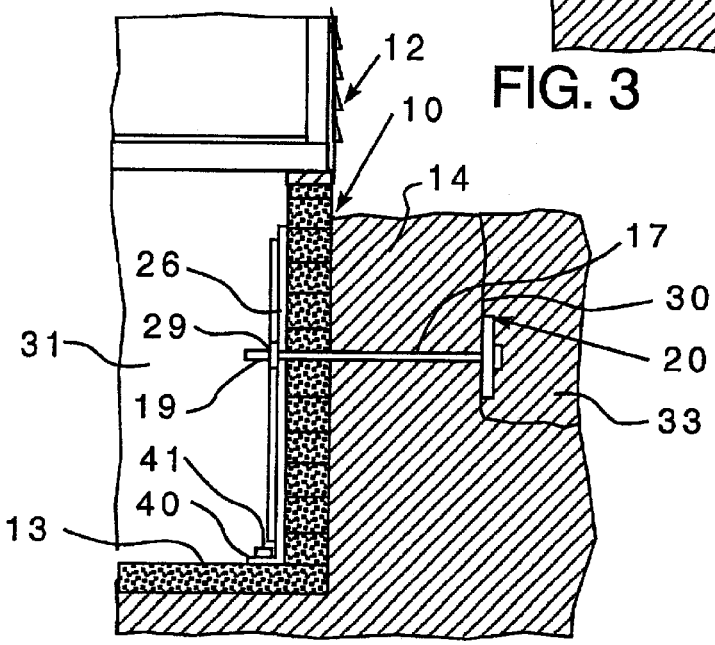
FIG. 5 is a cross sectional view similar to FIG. 3, but showing the relative positions of the wall and anchoring device after straightening of the wall has been accomplished.
Figure 4:
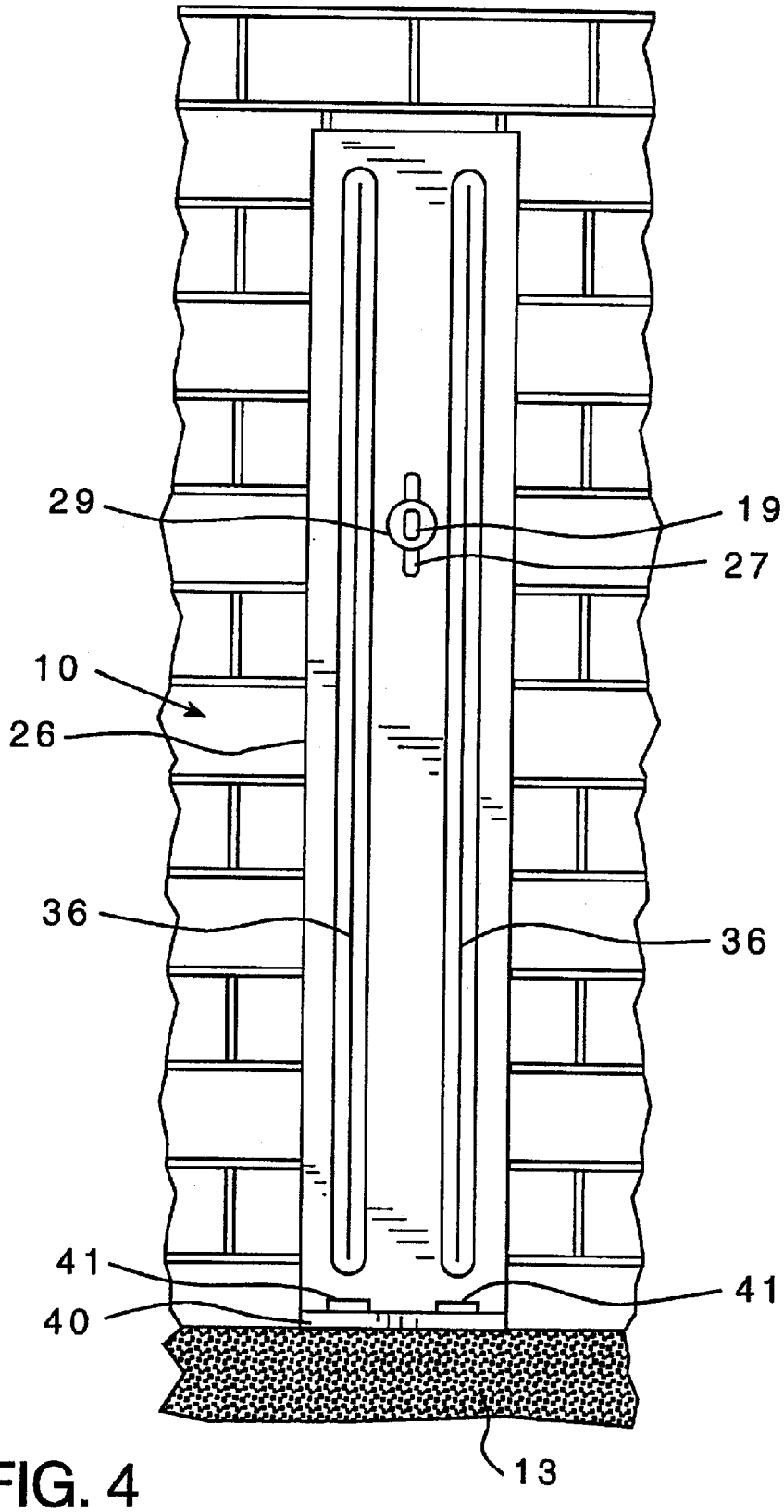
FIG. 4 is a view in front elevation illustrating the structure of the present invention as shown in FIG. 3 from inside the basement wall.

Once the structure shown in FIG. 2 has been positioned substantially as shown in FIG. 3, then a large wrench (not shown) or the like is utilized to thread the nut 29 further onto the threads 19 of the rod member 17 so as to force the wall plate 26 towards the wall 10 and thereby force the wall 10 back to the straight position as shown in FIGS. 4 and 5. At such time then the hole 30 can be refilled and the job is complete.

Elongate wall brace plate 26 is a stiff steel plate provided with forged elongate stiffening ribs 36 to further stiffen the plate.

Figures 6, 7:
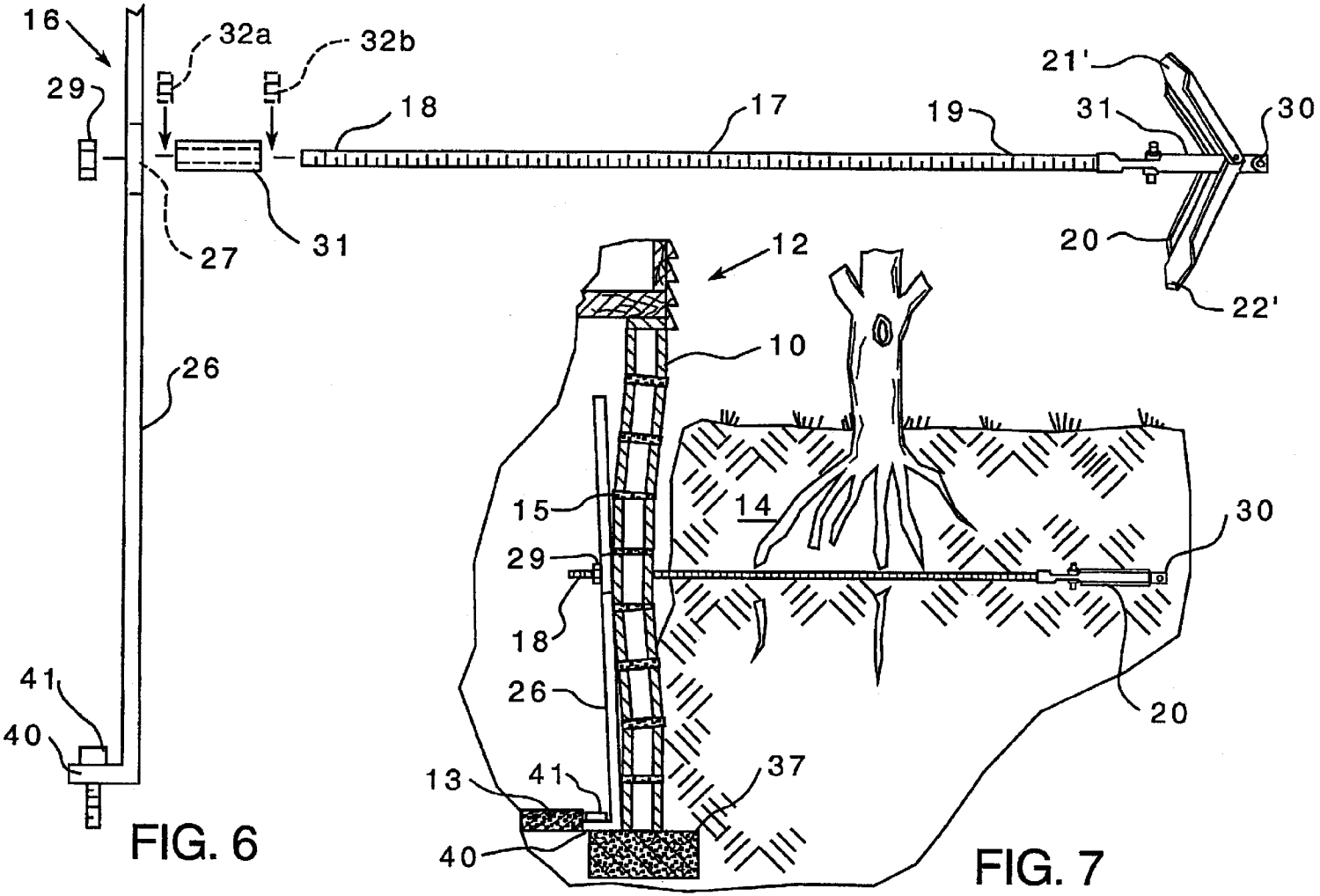
FIG. 6 is an exploded view in side elevation of a different or modified anchoring apparatus utilized in the present invention.
FIG. 7 is a cross sectional view of a basement wall which has been pushed in by hydrostatic pressure forces and has applied thereto the apparatus of the present invention as illustrated in FIG. 6.

Referring to FIGS. 6 and 7, similar elements are indicated with the same reference numerals. With the exception of the innovative elongate wall brace plate 26 and method of attachment utilized for the present invention, this embodiment otherwise follows the teachings of prior art reference U.S. Pat. No. 4,970,835.

Here the anchoring structure 16 comprises a hollow horizontally disposed elongate rod member 17 with a pointed chisel end 30 that is threadably engaged with the elongate threaded rod member 17. A sleeve 31 is provided to be inserted through the foundation wall 10, if desired, as a sealing means, but rubber grommets 32*a* and 32*b* may be optionally used as a wall sealing means. The sleeve 31 and/or grommets 32*a*, 32*b*, are provided for arrangement on the elongate threaded rod member 17 at an opening bored through the foundation wall 10. The hollow tube 17 carries pivotal spade arms 21' and 22', which are trough-shaped and arranged to pivot away from hollow tube 31 for anchoring engagement with the earth. At the opposite end of threaded elongate rod member 17, an elongate upright wall brace plate 26 of the present invention is provided to be placed against the interior of foundation wall 10 so that nut 29 may be threadably tightened on the threaded rod member 17 to pull the hollow tube 31 toward the foundation wall and thereby fully pivot the pivotal spade arms 21' and 22' outwardly to dig into the earth as is more fully explained in U.S. Pat. No. 4,970,835.

In this embodiment, elongate wall brace plate 26 is a steel plate of greater thickness than that illustrated in the previous figures and accordingly is not provided with the forged elongate stiffening ribs 36. Also, in this embodiment, as is best illustrated in FIG. 7, the securing means or mechanism at the bottom foot 40 of elongate plate 26 is secured directly to the foundation support 37 for wall 10 instead of to the slab floor 13. In this embodiment, the outer edge of slab floor 13 has been removed to expose foundation support 37, which is commonly done in any regard to provide drainage for any water which finds its way to the interior of the wall 10.

In practice, the threaded elongate rod member 17 is driven into the soil 14 through the opening provided in wall 10 and on into the adjacent earth, then the elongate brace plate 26 of the present invention is applied together with securing nut 29 and foot 40 is secured with bolts 41 to foundation 37. Securing nut 29 is then turned against elongate brace plate 26 which causes the spade arms 21' and 22' to be pulled inwardly towards wall 10 and in turn causes the spade arms 21' and 22' to spread and securely anchor the distal end of rod member 17 into earth 14. Further engagement and securing of nut 29 then causes elongate plate 24 to press against the interior of wall 10 for substantially its full height causing the wall to be straightened.

I claim:

1. A below ground wall anchoring and straightening device, comprising;

a horizontally disposed elongate rod member;

earth anchoring means secured to one end of said rod member;

a rigid unitary elongate wall brace plate attached intermediate its ends to the other end of said rod member through a vertical slot in said elongate wall brace plate;

said wall brace plate extending upright in its direction of elongation and being free of any support bracing and including securing means at a bottom end thereof for securing said bottom end to a base of an interiorly bowed wall structure to be straightened; and said rod member including a fastener for engaging said rod member and pressing said plate against a wall to be anchored and straightened.

2. The below ground wall anchoring and straightening device of claim 1 wherein said elongate wall brace plate is a rigid steel strip.

3. The below ground wall anchoring and straightening device of claim 1 wherein said fastener thread engages said rod.

4. A method for straightening an interiorly bowed below ground foundation wall comprising:

forming an opening through a foundation wall having an interior and an exterior;

driving an elongate rod member through said opening and into exterior surrounding earth;

anchoring a distal end of said elongate rod member in the surrounding earth;

securing a fastener onto a proximal end of said elongate rod member which extends through a vertical slot in a rigid unitary elongate upright plate and tightening said fastener against said elongate upright plate arranged interiorly against the foundation wall to be straightened;

securing a bottom end of said elongate plate to an interior base portion of the foundation wall to be straightened; and creating outward pressure against said foundation wall by further tightening of said fastener against said elongate plate.

* * * * *